US011341896B2

(12) United States Patent
Ko et al.

(10) Patent No.: US 11,341,896 B2
(45) Date of Patent: May 24, 2022

(54) SUBPIXEL DRIVING CIRCUIT COMPENSATING FOR VOLTAGE DROP AND ELECTROLUMINESCENT DISPLAY DEVICE COMPRISING THE SAME

(71) Applicant: LG Display Co., Ltd., Seoul (KR)

(72) Inventors: Hoyoung Ko, Paju-si (KR); JuhnSuk Yoo, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/600,431

(22) Filed: Oct. 11, 2019

(65) Prior Publication Data

US 2020/0175911 A1 Jun. 4, 2020

(30) Foreign Application Priority Data

Nov. 29, 2018 (KR) ..... 10-2018-0150786

(51) Int. Cl.
*G09G 3/30* (2006.01)
*G09G 3/20* (2006.01)

(52) U.S. Cl.
CPC ..... *G09G 3/30* (2013.01); *G09G 3/2003* (2013.01); *G09G 2300/0452* (2013.01);
(Continued)

(58) Field of Classification Search
CPC ..... G09G 3/30; G09G 3/2003; G09G 3/325
See application file for complete search history.

(56) References Cited

U.S. PATENT DOCUMENTS 10,004,124 B1 * 6/2018 Ko ..... G09G 3/3233
2013/0140537 A1 * 6/2013 Ha ..... H01L 27/3262 257/40

(Continued)

FOREIGN PATENT DOCUMENTS

CN 102222468 A 10/2011
CN 103137067 A 6/2013

(Continued)

OTHER PUBLICATIONS

Chinese Office Action dated Jan. 19, 2022 issued in Patent Application No. 201911201647.X w/English Translation (21 pages).

*Primary Examiner* — William Boddie
*Assistant Examiner* — Andrew B Schnirel
(74) *Attorney, Agent, or Firm* — Polsinelli PC

(57) ABSTRACT

An electroluminescent display device comprises a pixel including a plurality of subpixels; a plurality of power lines for providing a power voltage to the plurality of subpixels; a data line for providing data signals to the plurality of subpixels; a plurality of gate lines for providing gate signals to the plurality of subpixels; and a reference node line for connecting a plurality of reference nodes included in the plurality of subpixels, wherein each of the subpixels comprises a light emitting diode and a subpixel driving circuit for controlling light emission of the light emitting diode, and wherein the subpixel driving circuit provides a driving current without including a high potential voltage to the light emitting diode as a reference voltage that is applied from one of the plurality of power lines to the reference node included in the subpixel driving circuit, and some of the plurality of subpixels include a compensation transistor connected to the reference node receiving the reference voltage.

17 Claims, 7 Drawing Sheets

(52) U.S. Cl.
CPC ..... *G09G 2300/0819* (2013.01); *G09G 2310/0202* (2013.01); *G09G 2320/0209* (2013.01); *G09G 2320/0233* (2013.01)

(56) References Cited

U.S. PATENT DOCUMENTS

| | | | | |
|---|---|---|---|---|
| 2014/0111503 | A1* | 4/2014 | Kwon | G09G 3/3233 345/213 |
| 2014/0176523 | A1* | 6/2014 | Kwak | G09G 3/3233 345/212 |
| 2017/0365215 | A1* | 12/2017 | He | G09G 3/20 |
| 2018/0130410 | A1* | 5/2018 | Gao | G09G 3/3225 |
| 2019/0043426 | A1* | 2/2019 | Zhang | G09G 3/3233 |
| 2019/0066598 | A1* | 2/2019 | Kim | G09G 3/3266 |
| 2019/0164491 | A1* | 5/2019 | Kim | H01L 27/3248 |
| 2020/0175911 | A1* | 6/2020 | Ko | G09G 3/325 |

FOREIGN PATENT DOCUMENTS

| | | | |
|---|---|---|---|
| CN | 103137653 | A | 6/2013 |
| CN | 105448244 | A | 3/2016 |
| CN | 107274830 | A | 10/2017 |

* cited by examiner

SUBPIXEL DRIVING CIRCUIT COMPENSATING FOR VOLTAGE DROP AND ELECTROLUMINESCENT DISPLAY DEVICE COMPRISING THE SAME

CROSS REFERENCE TO RELATED APPLICATION

This application claims the benefit of a Korean application No. 10-2018-0150786 filed on Nov. 29, 2018, which is hereby incorporated by reference in its entirety.

BACKGROUND

Field of the Disclosure

The present disclosure relates to an electroluminescent display device, and more particularly, to an electroluminescent display device comprising a subpixel driving circuit capable of compensating for a voltage drop.

Description of the Background

With the advancement of the information technology, the market for a display device which is a connection medium between a user and information has grown. Therefore, use of various types of display devices such as an electroluminescent display device, a liquid crystal display (LCD) device, and a quantum dot light emitting display (QLED) device has been increased.

A display device comprises a display panel including a plurality of subpixels, a driver for driving the display panel, and a power supply unit for supplying a power source to the display panel. The driver includes a gate driver for supplying a gate signal to the display panel and a data driver for supplying a data signal to the display panel.

For example, the electroluminescent display device may display an image as a light emitting diode of a subpixel emits light if the gate signal and the data signal are supplied to the subpixel. The light emitting diode may be implemented based on an organic material or an inorganic material.

Since the electroluminescent display device displays an image based on light generated from the light emitting diode within the subpixel, the electroluminescent display device has various advantages, whereby exactness of a subpixel driving circuit for controlling luminescence of the subpixel is required. For example, time-varying characteristics (or changes over the time) in which a threshold voltage of a transistor included in the subpixel driving circuit is changed may be compensated, whereby exactness of the subpixel driving circuit may be improved.

There are various methods for compensating for time-varying characteristics of the electroluminescent display device. However, since drop of a voltage applied to a subpixel is not considered, some of compensation methods which are generally suggested cause a picture quality issue such as non-uniform vertical luminance or crosstalk on the display panel.

Therefore, a design method of a subpixel driving circuit for allowing subpixels to emit light at uniform luminance has been studied.

SUMMARY

Accordingly, the present disclosure is directed to an electroluminescent display device using a subpixel driving circuit that substantially obviate one or more of the issues due to limitations and disadvantages of the related art.

The present disclosure has been made in view of the above problems, and it is an object of the present disclosure to provide an electroluminescent display device, in which a picture quality issue such as non-uniform vertical luminance or crosstalk on a display panel is solved by compensation of time-varying characteristics considering a voltage drop for a voltage applying line.

The present disclosure provides a subpixel driving circuit and an electroluminescent display device comprising the same, in which a subpixel driving circuit per subpixel is designed to include a circuit for efficiently providing a reference voltage and thus a driving current excluding a high potential voltage capable of generating a voltage drop for a voltage applying line is generated.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the present disclosure as embodied and broadly described, there is provided an electroluminescent display device comprising a pixel including a plurality of subpixels, a plurality of power lines for providing a power voltage to the plurality of subpixels, a data line for providing data signals to the plurality of subpixels, a plurality of gate lines for providing gate signals to the plurality of subpixels, and a reference node line for connecting a plurality of reference nodes included in the plurality of subpixels. Each of the subpixels comprises a light emitting diode, and a subpixel driving circuit for controlling light emission of the light emitting diode, the subpixel driving circuit provides a driving current without including a high potential voltage to the light emitting diode as a reference voltage that is applied from one of the plurality of power lines to the reference node included in the subpixel, and some of the plurality of subpixels include a compensation transistor connected to the reference node receiving the reference voltage. Therefore, since the reference voltage is applied to the reference node of the subpixels connected through the reference node line, the reference voltage provided to the reference node through the compensation transistor included in some of the subpixels may solve a picture quality issue of the electroluminescent display device by providing the driving current which is not affected by the high potential voltage to the light emitting diode.

In another aspect, there is provided an electroluminescent display device comprising a unit pixel existing in a minimum area where all colors can be expressed through combination of three primary colors, the unit pixel includes at least one subpixel including a first compensation transistor and at least one subpixel including a second compensation transistor, the at least one subpixel includes a reference node for providing a reference voltage transferred through a light emitting diode, a driving transistor, switching transistors, a capacitor, and the first compensation transistor or the second compensation transistor, and a reference node line for connecting the reference node is arranged in the unit pixel. Therefore, since the reference voltage is applied to the reference node of the subpixels included in the unit pixel through the compensation transistor and the reference voltage is applied to the reference node of the other subpixels within the unit pixel through the reference node line, the driving current which is not affected by the high potential voltage may be provided to the light emitting diode, whereby a problem of picture quality of the electroluminescent display device may be solved.

Details of the other aspects are included in the detailed description and drawings.

According to the aspects of the present disclosure, since the subpixel driving circuit included in some of subpixels includes a compensation transistor for transferring a reference voltage, a driving current in which a high potential voltage capable of generating a voltage drop by a line is not included may be provided to a light emitting diode, whereby a picture quality problem such as non-uniform vertical luminance or crosstalk of the electroluminescent display device may be solved.

According to the aspects of the present disclosure, a reference voltage is provided to subpixels through a reference node line connected to a reference node for a time period when an n−1th scan signal and an nth scan signal correspond to gate-on voltages, whereby the subpixel driving circuit included in the subpixels may compensate for time-varying characteristics considering a voltage drop of a high potential voltage.

According to the aspects of the present disclosure, a unit pixel comprises a subpixel including a first compensation transistor turned on by an n−1th scan signal and implemented to apply a reference voltage to a reference node, and a subpixel including a second compensation transistor turned on by an nth scan signal and implemented to apply a reference voltage to a reference node, whereby the subpixels included in the unit pixel may emit light by a driving current considering a voltage drop of a high potential voltage.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with aspects of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, that may be included to provide a further understanding of the disclosure and are incorporated in and constitute a part of this application, illustrate aspects of the disclosure and together with the description serve to explain various principles of the disclosure.

In the drawings.

Figure 1:
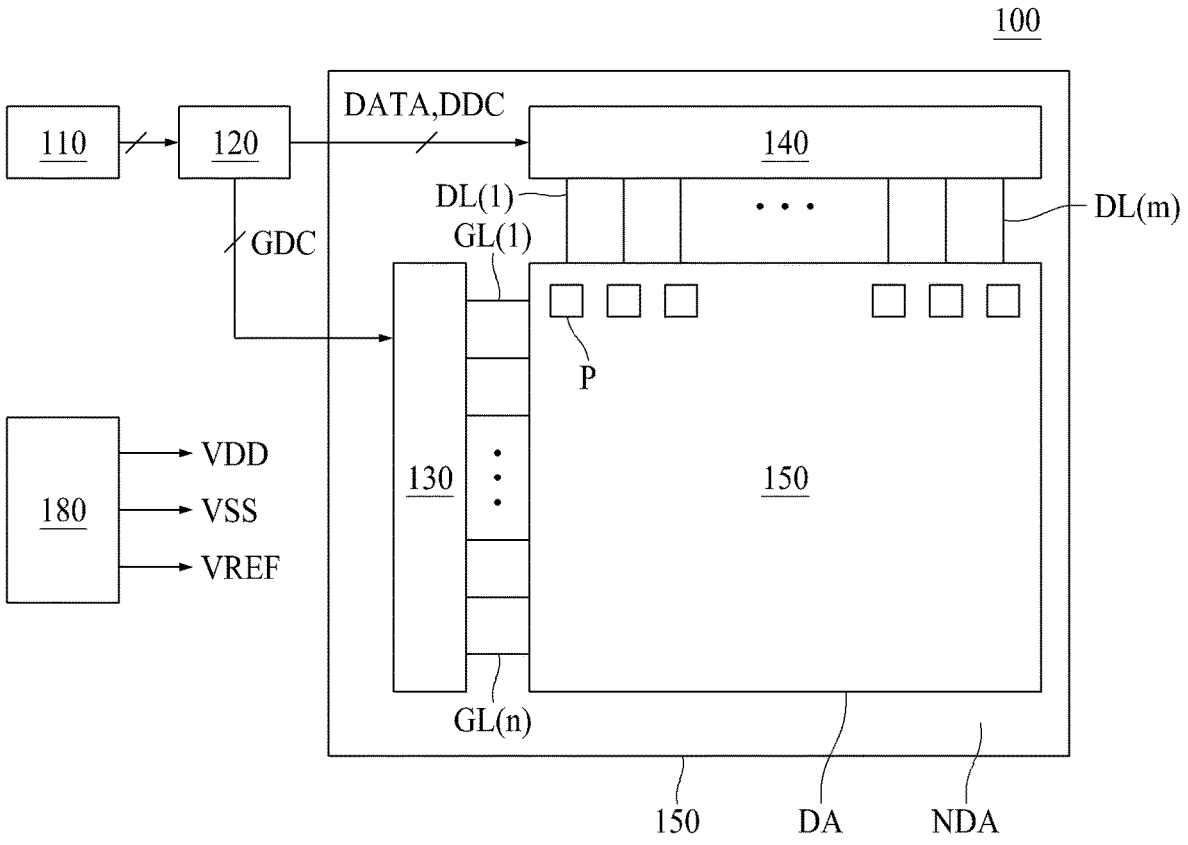
FIG. 1 is a block diagram illustrating an electroluminescent display device according to an aspect of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to aspects of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

It will be understood that, although the terms "first," "second," etc. May be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

In the description of aspects, when a structure is described as being positioned "on or above" or "under or below" another structure, this description should be construed as including a case in which the structures contact each other as well as a case in which a third structure is disposed therebetween. The size and thickness of each element shown in the drawings are given merely for the convenience of description, and aspects of the present disclosure are not limited thereto.

The terms "first horizontal axis direction," "second horizontal axis direction," and "vertical axis direction" should not be interpreted only based on a geometrical relationship in which the respective directions are perpendicular to each other, and may be meant as directions having wider directivities within the range within which the components of the present disclosure can operate functionally.

Features of various aspects of the present disclosure may be partially or overall coupled to or combined with each other, and may be variously inter-operated with each other and driven technically as those skilled in the art can sufficiently understand. Aspects of the present disclosure may be carried out independently from each other, or may be carried out together in co-dependent relationship.

In the present disclosure, a gate driver on a substrate of a display panel may be implemented with an N-type or P-type transistor. For example, the transistor may be implemented with a transistor having a metal oxide semiconductor field effect transistor (MOSFET) structure. The transistor may be a three-electrode device, including a gate, a source, and a drain. The source may supply a carrier to the transistor. In the transistor, the carrier may start to move from the source. The drain may be an electrode through which the carrier may move from the transistor to the outside.

For example, in the transistor, the carrier may move from the source to the drain. In an N-type transistor, because the carrier is an electron, a voltage of the source is lower than a voltage of the drain for the electron to move from the source to the drain. In the N-type transistor, because the electron moves from the source to the drain, a current moves from the drain to the source. In a P-type transistor, because the carrier is a hole, the voltage of the source is higher than the voltage of the drain for the hole to move from the source to the drain. In the P-type transistor, because the hole moves from the source to the drain, a current moves from the source to the drain. The source and the drain of the transistor may not be fixed and may be switched in accordance with an applied voltage.

Hereinafter, a gate-on voltage may be a voltage of a gate signal for turning on a transistor. A gate-off voltage may be a voltage for turning off the transistor. For example, in a p-type transistor, the gate-on voltage may be a logic low voltage VL, and the gate-off voltage may be a logic high voltage VH. In an n-type transistor, the gate-on voltage may be a logic high voltage, and the gate-off voltage may be a logic low voltage. The inventors of the present disclosure have recognized the aforementioned problems and have invented a display device for reducing a voltage drop for a voltage applying line.

Hereinafter, a subpixel driving circuit and an electroluminescent display device comprising the same according to the aspect of the present disclosure will be described with reference to the accompanying drawings.

FIG. 1 is a block diagram illustrating an electroluminescent display device according to an example aspect of the present disclosure.

With reference to FIG. 1, the electroluminescent display device 100 comprises an image processor 110, a timing controller 120, a gate driver 130, a data driver 140, a display panel 150, and a power supply unit 180.

The image processor 110 outputs driving signals for driving various kinds of devices along with externally supplied image data. The driving signals outputted from the image processor 110 may include a data enable signal, a vertical synchronization signal, a horizontal synchronization signal, and a clock signal.

The timing controller 120 receives the image data and the driving signals, etc. from the image processor 110. The timing controller 120 outputs a gate timing control signal GDC for controlling the operation timing of the gate driver 130 and a data timing control signal DDC for controlling the operation timing of the data driver 140, based on the driving signals.

The gate driver 130 outputs gate signals in response to the gate timing control signal GDC supplied from the timing controller 120. The gate driver 130 outputs the gate signals through gate lines GL(1) to GL(n). The gate driver 130 may be provided in the form of an IC (integrated circuit), or may be provided in the form a gate-in-panel (GIP) built in a display panel 150. The gate driver 130 may be at each of left and right sides of the display panel 150, or may be at one side of the left and right sides, although aspects are not limited to these sides. The gate driver 130 comprises a plurality of stages. For example, a first stage of the gate driver 130 outputs a first gate signal for driving a first gate line of the display panel 150.

The data driver 140 outputs data signals in response to the data timing control signal DDC supplied from the timing controller 120. The data driver 140 samples and latches a digital data signal DATA supplied from the timing controller 120 and, converts the digital data signal DATA into an analog data signal based on a gamma reference voltage. The data driver 140 outputs data signals to the display panel 150 through data lines DL(1) to DL(m). The data driver 140 may be provided on the display panel 150 in the form of an IC (integrated circuit), or may be provided on the display panel 150 in the form of a chip-on-film (COF).

The power supply unit 180 outputs a high potential voltage VDD, a low potential voltage VSS and a reference voltage VREF. The high potential voltage VDD, the low potential voltage VSS and the reference voltage VREF output from the power supply unit 180 are supplied to the display panel 150. The high potential voltage VDD is supplied to the display panel 150 through a high potential voltage line, and the low potential voltage VSS is supplied to the display panel 150 through a low potential voltage line. The voltages output from the power supply unit 180 may be used by the gate driver 130 or the data driver 140.

The display panel 150 displays an image in response to the gate signals and the data signals respectively supplied from the gate driver 130 and the data driver 140, and the power source supplied from the power supply unit 180. The display panel 150 comprise pixels P operating to display an image.

The display panel 150 includes a display area DA in which the pixels P are arranged in row and column, and a non-display area NDA where various signal lines or pads are formed outside the display area DA. Because the display area DA is an area in which an image is displayed, the pixels P are in the display area DA. Because the non-display area NDA is an area in which an image is not displayed, dummy pixels are in the non-display area NDA but the pixels P are not therein.

The pixel P includes a plurality of subpixels, and displays an image based on gray displayed by each subpixel. Each subpixel is connected with a data line arranged along a column line (or column direction), and is connected to a gate line (or pixel line) arranged along a row line (or row direction). The subpixels on a same pixel line are driven simultaneously while sharing a same gate line. When the subpixels arranged in a first pixel line are defined as "first subpixels" and the subpixels arranged in an nth pixel line are defined as "nth subpixels", the first subpixels to the nth subpixels are driven sequentially.

The pixels of the display panel 150 are arranged in the form of matrix to constitute a pixel array, but aspects are not limited to this case. For example, the pixels may be arranged in various forms, such as a stripe form, and a diamond form, in addition to the matrix form. When a minimum area which can express all colors through combination of three primary colors of red, green and blue is defined as a unit pixel, a size and shape of the unit pixel may be changed in accordance with an arrangement form of the pixels. As the case may be, the subpixels may include white and yellow in addition to red, green and blue.

The pixels P may include two or more of red subpixels, green subpixels, and blue subpixels, may include two or more of white subpixels, red subpixels, green subpixels, and blue subpixels, or may include two or more of red subpixels, green subpixels, blue subpixels and yellow subpixels. The subpixels may have one or more different light-emission areas depending on the light-emission characteristics. For example, a pixel which includes red subpixels, green subpixels and blue subpixels may constitute a unit pixel. Otherwise, a pixel which includes red subpixels and green subpixels and a pixel which includes blue subpixels and green subpixels may constitute a unit pixel. Otherwise, a pixel which includes red subpixels and green subpixels and a pixel which includes blue subpixels and white subpixels may constitute a unit pixel. Otherwise, a pixel which includes red subpixels and blue subpixels and a pixel which includes green subpixels and yellow subpixels may constitute a unit pixel. Otherwise, of a pixel which includes red subpixels, green subpixels and blue subpixels, a pixel which includes and a pixel which includes white subpixels and any two of red subpixels, green subpixels and blue subpixels, the red subpixels, the green subpixels, the blue subpixels and the white subpixels may constitute a unit pixel.

Figure 2:
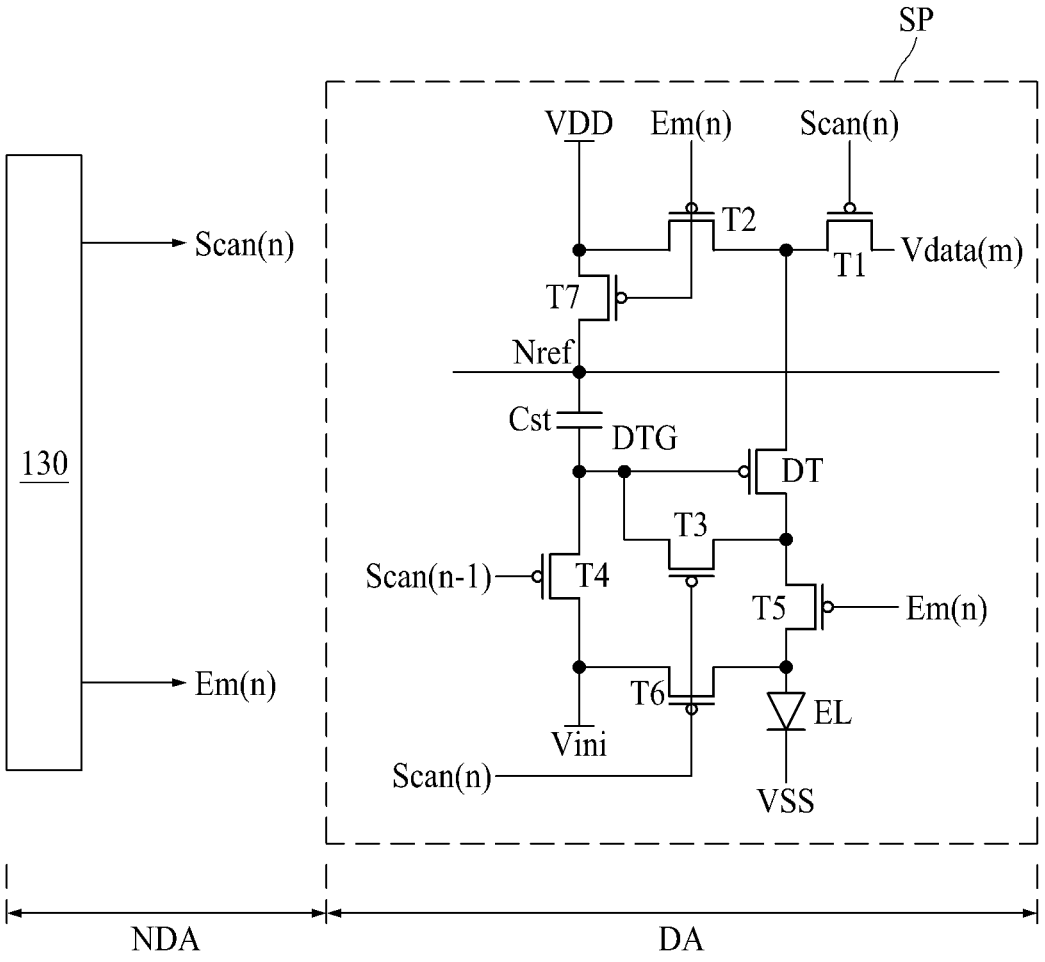
FIG. 2 is a subpixel driving circuit according to an aspect of the present disclosure.
Figure 3:
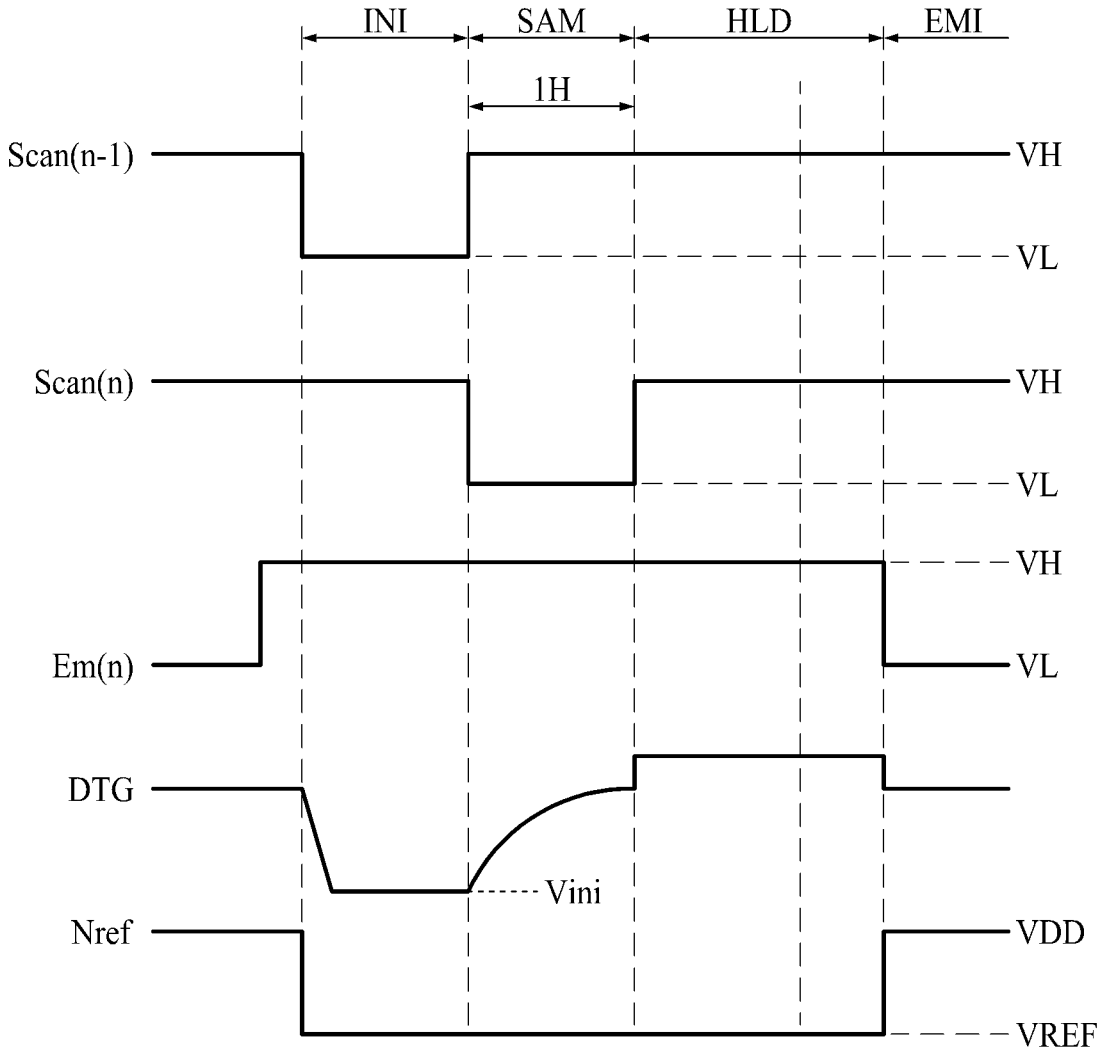
FIG. 3 is a waveform diagram illustrating driving characteristics of a subpixel driving circuit shown in FIG. 2.

FIG. 2 is a subpixel driving circuit according to an example aspect of the present disclosure. FIG. 3 is a waveform diagram illustrating driving characteristics of a subpixel driving circuit shown in FIG. 2. Subpixels SP which are in an nth row and an mth column will be described with reference to FIG. 2.

The display panel 150 includes a display area DA in which an image is displayed based on subpixels SP and a non-display area NDA in which a signal line or a driving circuit is arranged and an image is not displayed.

The electroluminescent display device 100 display an image based on light generated from a light emitting diode EL included in the subpixels SP. However, because the electroluminescent display device 100 has time-varying characteristics (or changes over time) in which a threshold voltage of an element (e.g., driving transistor or the like) included in the subpixel SP is changed, it is required to compensate for the threshold voltage.

Therefore, a subpixel driving circuit for solving a picture quality issue such as non-uniform vertical luminance or crosstalk of the electroluminescent display device 100 according to the aspect of the present disclosure will be described. The subpixel driving circuit which will be described later includes, but aspects are not limited to, P type transistors, for example. The subpixel driving circuit according to the aspect of the present disclosure is applicable to N type transistors.

As shown in FIGS. 2 and 3, in the electroluminescent display device 100 according to an example aspect, the reference voltage VREF is externally applied to the reference node Nref to reduce a voltage drop of the high potential voltage VDD applied to the subpixel SP. An nth scan signal Scan(n) and an nth light emission control signal Em(n) are provided to the subpixel SP. In this case, the externally applied voltage means the voltage applied from the non-display area NDA corresponding to the outside of the display area DA. The reference voltage VREF may be provided from a power supply unit separately packaged in the display panel 150, or the nth scan signal Scan(n) and the nth light emission control signal Em(n) may be provided from the gate driver 130 arranged in the non-display area NDA.

The reference voltage VREF applied through a reference voltage line is transferred to the reference node Nref of the subpixel SP for a specific period. The reference voltage VREF may have a voltage level between the high potential voltage VDD and the low potential voltage VSS or a voltage level equivalent to the high potential voltage VDD. For example, the high potential voltage may be 4.6V, and the reference voltage may be 4.0V.

The gate driver 130 includes a scan driver and an emission driver, which supply a scan signal and a light emission control signal to the subpixels SP arranged along a pixel line. Each of the scan driver and the emission driver includes a plurality of stages. An nth stage of each of the scan driver and the emission driver outputs the nth scan signal Scan(n) and the nth light emission signal Em(n) to drive the nth subpixel SP.

The subpixel SP according to the aspect of the present disclosure includes a subpixel driving circuit and a light emitting diode EL, and the subpixel driving circuit includes first to seventh transistors T1 to T7, a driving transistor DT, and a capacitor Cst. In the shown aspect of the present disclosure, the subpixel SP is implemented based on a total of eight transistors and one capacitor. However, the aspect of the present disclosure is not limited to the shown aspect. Hereinafter, a configuration and a connection relation of the nth subpixel SP will be described.

Referring to FIGS. 2 and 3, the driving transistor DT includes a gate connected to a gate node DGT, a source, and a drain. The source of the driving transistor DT is a first electrode of the driving transistor DT, and the drain of the driving transistor DT is a second electrode of the driving transistor DT.

A gate of the first transistor T1 is connected to the nth scan line, a first electrode of the first transistor T1 is connected to the mth data line DL(m), and a second electrode of the first transistor T1 is connected to a first electrode of the second transistor T2 and the first electrode of the driving transistor DT. The first transistor T1 is turned on to correspond to the nth scan signal Scan(n) of the logic low voltage VL applied through the nth scan line. If the first transistor T1 is turned on, the data voltage Vdata(m) applied through the mth data line DL(m) is applied to the second electrode of the first transistor T1.

A gate of the second transistor T2 is connected to the nth light emission control signal line, a first electrode of the second transistor T2 is connected to the second electrode of the first transistor T1, and a second electrode of the second transistor T2 is connected to a high potential power line and a first electrode of the seventh transistor T7. The second transistor T2 is turned on to correspond to the nth light emission control signal Em(n) of the logic low voltage VL applied through the nth light emission control signal line. If the second transistor T2 is turned on, the data voltage Vdata(m) charged in the second electrode of the first transistor T1 is transferred to one end of the capacitor Cst through the second transistor T2 and the seventh transistor T7.

A gate of the third transistor T3 is connected to the nth scan line, a first electrode of the third transistor T3 is connected to the second electrode of the driving transistor DT, and a second electrode of the third transistor T3 is connected to the gate of the driving transistor DT. The third transistor T3 is turned on to correspond to the nth scan signal Scan(n) of the logic low voltage VL applied through the nth scan line. If the third transistor T3 is turned on, because the gate and the second electrode of the driving transistor DT are conducted, the driving transistor DT becomes a diode connection state.

A gate of the fourth transistor T4 is connected to the n−1th scan line, a first electrode of the fourth transistor T4 is connected to an initialization voltage line, and a second electrode of the fourth transistor T4 is connected to the other end of the capacitor Cst, the second electrode of the third transistor T3 and the gate of the driving transistor DT. The fourth transistor T4 is turned on to correspond to the n−1th scan signal Scan(n−1) of the logic low voltage VL applied through the n−1th scan line. If the fourth transistor T4 is turned on, a gate node DTG of the driving transistor DT is initialized based on an initialization voltage Vini. In this case, the gate node DTG of the driving transistor DT is connected with the gate of the driving transistor DT.

A gate of the fifth transistor T5 is connected to the nth light emission control signal line, a first electrode of the fifth transistor T5 is connected to the second electrode of the driving transistor DT, and a second electrode of the fifth transistor T5 is connected to an anode of the light emitting diode EL. The fifth transistor T5 is turned on to correspond to the nth light emission control signal Em(n) of the logic low voltage VL applied through the nth light emission control signal line. If the fifth transistor T5 is turned on, the light emitting diode EL emits light to correspond to a driving current provided through the driving transistor DT.

A gate of the sixth transistor T6 is connected to the nth scan line, a first electrode of the sixth transistor T6 is connected to the initialization voltage line, and a second electrode of the sixth transistor T6 is connected to the second electrode of the fifth transistor T5 and the anode of the light emitting diode EL. The sixth transistor T6 is turned on to correspond to the nth scan signal Scan(n) of the logic low voltage VL applied through the nth scan line. If the sixth transistor T6 is turned on, the anode of the light emitting diode EL is initialized based on the initialization voltage Vini.

A gate of the seventh transistor T7 is connected to the nth light emission control signal line, a first electrode of the seventh transistor T7 is connected to the high potential power line and the second electrode of the second transistor T2, and a second electrode of the seventh transistor T7 is connected to one end of the capacitor Cst. The seventh transistor T7 is turned on to correspond to the nth light emission control signal Em(n) of the logic low voltage VL applied through the nth light emission control signal line. If the seventh transistor T7 is turned on, the data voltage Vdata(m) charged in the second electrode of the first transistor T1 is transferred to one end of the capacitor Cst through the second transistor T2.

One end of the capacitor Cst is connected to the second electrode of the seventh transistor T7, and the other end of the capacitor Cst is connected to the second electrode of the fourth transistor T4. A node connected to the second electrode of the seventh transistor T7 and one end of the capacitor Cst is defined as the reference node Nref to which the reference voltage VREF is transferred. The anode of the light emitting diode EL is connected to the second electrode of the fifth transistor T5, and a cathode of the light emitting diode EL is connected to a low potential power line. The low potential voltage VSS is applied to the cathode through the low potential power line.

Referring to FIG. 3, the subpixel SP according to the aspect of the present disclosure operates in the order of a first initialization period INI, a sampling and second initialization period SAM, a holding period HLD, and a light emission period EMI. The first initialization period INI is a period for initializing the gate node DTG of the driving transistor DT. The sampling and second initialization period SAM is a period for initializing the light emitting diode EL while sampling the threshold voltage of the driving transistor DT. The holding period HLD is a period for maintaining the data voltage Vdata(m) applied through the mth data line DL(m) in a specific node. The light emission period EMI is a period for allowing the light emitting diode EL to emit light through the driving current generated based on the data voltage Vdata(m).

As the subpixel SP according to the aspect of the present disclosure has the first initialization period INI and the sampling and second initialization period SAM for a period (period for maintaining the logic high voltage VH) for not applying the nth light emission control signal Em(n), internal circuit based compensation is performed. Operation characteristics for these periods are as follows. As an example, the n−1th scan signal Scan(n−1) and the nth scan signal Scan(n) are applied to the logic low voltage VL for one horizontal period (1H). Also, each of the first initialization period INI and the sampling and second initialization period SAM is performed for one horizontal period (1H).

For the first initialization period INI, the fourth transistor T4 is turned on to correspond to the n−1th scan signal Scan(n−1) of the logic low voltage VL applied through the n−1th scan line. In this case, the initialization voltage Vini lower than the high potential voltage VDD applied through the high potential power line is applied to the initialization voltage line. By this operation, the gate node DTG of the driving transistor DT is initialized based on the initialization voltage Vini. The reference voltage VREF is applied to the reference node Nref to initialize one end of the capacitor Cst to the reference voltage.

For the sampling and second initialization period SAM, the first transistor T1, the third transistor T3 and the sixth transistor T6 are turned on to correspond to the nth scan signal Scan(n) of the logic low voltage VL applied through the nth scan line. The reference voltage VREF is continuously applied to the reference node Nref. The data voltage Vdata(m) applied through the mth data line DL(m) by the turn-on operation of the first transistor T1 is applied to the first electrode of the driving transistor DT. Because the driving transistor DT becomes a diode connection state by the turn-on operation of the third transistor T3, the threshold voltage of the driving transistor DT is sampled. The data voltage Vdata(m) applied to the first electrode of the driving transistor DT is charged in the gate node DTG of the driving transistor DT. Also, the light emitting diode EL is initialized based on the initialization voltage Vini by the turn-on operation of the sixth transistor T6.

The holding period HLD is varied depending on a period of a clock signal of a light emitting driver for outputting the nth light emission control signal Em(n) and a period of a clock signal of the scan driver for outputting the nth scan signal Scan(n). For example, the holding period HLD may be one horizontal period 1H or more. For the holding period HLD, the capacitor Cst charges and maintains the data voltage based on a voltage difference between both ends. As the nth scan signal Scan(n) is shifted from the logic low voltage VL to the logic high voltage VH for the holding period HLD, the voltage of the gate node DTG of the driving transistor DT may be varied a little by a parasitic capacitor.

For the light emission period EMI, the second transistor T2, the seventh transistor T7 and the fifth transistor T5 are turned on to correspond to the nth light emission control signal Em(n) of the logic low voltage VL applied through the nth light emission control signal line. The high potential voltage VDD applied through the high potential power line by the turn-on operation of the second transistor T2 is applied to the first electrode of the driving transistor DT. The high potential voltage VDD applied through the high potential power line by the turn-on operation of the seventh transistor T7 is applied to the reference node Nref which is one end of the capacitor Cst. In this case, the voltage of the gate node DTG of the driving transistor DT, which is the other end of the capacitor Cst, is changed by being subjected to coupling as much as the voltage of the reference node Nref, which is shifted from the reference voltage VREF to the high potential voltage VDD.

As the reference voltage VREF is provided to the reference node Nref such that a voltage drop value of the high potential voltage VDD is considered for the first initialization period INI and the sampling and second initialization period SAM, the subpixel SP according to the aspect of the present disclosure is compensated. Therefore, the current of the compensated subpixel SP is expressed as the following equation.

$$Ioled=K(Vsg-|Vth|)^2=K\{(VDD-(V\text{data}(m)-|Vth|+VDD-V\text{REF})-|Vth|\}^2=K(V\text{REF}-V\text{data}(m))^2$$

In the above equation, Ioled denotes a current flowing through the light emitting diode EL, K denotes a constant, Vsg denotes the voltage between the source and the gate of the driving transistor DT, Vth denotes the threshold voltage of the driving transistor DT, VDD denotes the high potential voltage applied through the high potential power line, VREF denotes the reference voltage applied through the reference voltage line, and Vdata(m) denotes the data voltage applied through the mth data line DL(m).

As noted in the above equation, Ioled is determined by the difference between the reference voltage VREF and the data voltage Vdata(m). According to the equation, it is noted from the nth subpixel SP according to the aspect of the present disclosure that the voltage drop value of the high potential voltage VDD applied through the high potential power line can be compensated by the reference voltage VREF applied for the first initialization period INI and the sampling and second initialization period SAM.

Hereinafter, the subpixel driving circuit for providing the reference voltage VREF to the reference node Nref for the first initialization period INI and the sampling and second initialization period SAM will be described.

Figure 4:
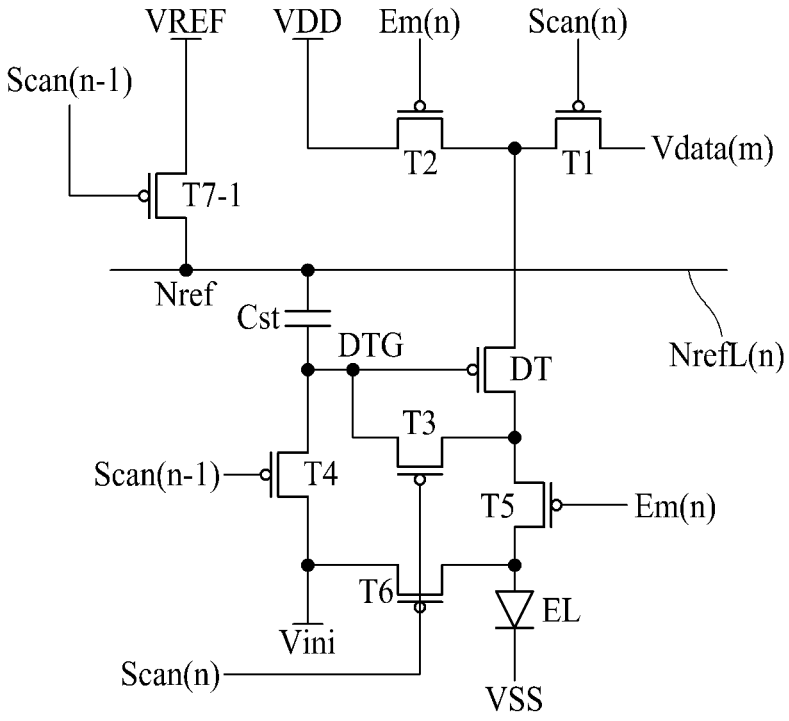
FIGS. 4 and 5 are a subpixel driving circuit included in a unit pixel according to an aspect of the present disclosure.
Figure 5:
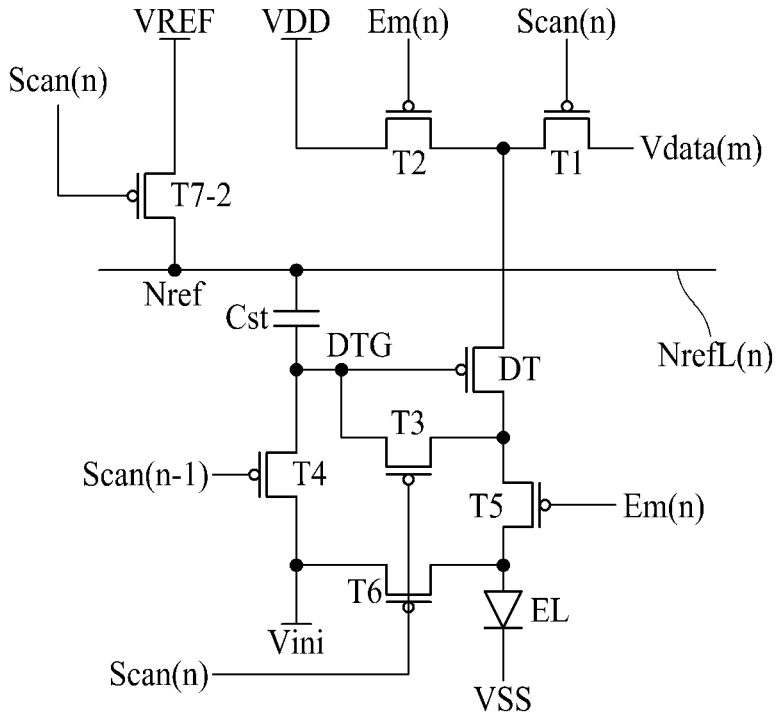

FIGS. 4 and 5 are a subpixel driving circuit included in a unit pixel according to an example aspect of the present disclosure. The subpixel driving circuit of FIGS. 4 and 5 is modified from the subpixel driving circuit according to an example aspect of FIG. 2, and the connection relation of the other transistors T1 to T6 and the capacitor except the seventh transistor T7 is equally applied to the subpixel driving circuit of FIGS. 4 and 5. Therefore, description repeated with FIG. 2 will be omitted or briefly described.

Referring to FIG. 4, the subpixel driving circuit of FIG. 2 includes a 7-1th transistor T7-1 instead of the seventh transistor T7. A gate of the 7-1th transistor T7-1 is connected to the n−1th scan line, a first electrode of the 7-1th transistor T7-1 is connected to the reference voltage line, and a second electrode of the 7-1th transistor T7-1 is connected to the reference node Nref which is one end of the capacitor Cst. The 7-1th transistor T7-1 is turned on to correspond to the n−1th scan signal Scan(n−1) of the logic low voltage VL applied through the n−1th scan line. If the 7-1th transistor T7-1 is turned on, the reference voltage VREF provided through the reference voltage line is transferred to the reference node Nref which is one end of the capacitor Cst. The reference node Nref according to an example aspect is connected to the reference node of an adjacent subpixel through the reference node line. The reference node line for connecting the reference node Nref of the subpixel in the nth pixel line is defined as the nth reference node line NrefL(n). The reference node line will be described with reference to FIGS. 6 and 7.

Referring to FIG. 5, the subpixel driving circuit includes a 7-2th transistor T7-2 instead of the seventh transistor T7. A gate of the 7-2th transistor T7-2 is connected to the nth scan line, a first electrode of the 7-2th transistor T7-2 is connected to the reference voltage line, and a second electrode of the 7-2th transistor T7-2 is connected to the reference node Nref which is one end of the capacitor Cst. The 7-2th transistor T7-2 is turned on to correspond to the nth scan signal Scan(n) of the logic low voltage VL applied through the nth scan line. If the 7-2th transistor T7-2 is turned on, the reference voltage VREF provided through the reference voltage line is transferred to the reference node Nref which is one end of the capacitor Cst.

In the subpixel driving circuit of FIG. 4, the reference voltage VREF is applied to the reference node Nref for a period when the n−1th scan signal Scan(n−1) corresponds to a gate-on voltage. In the subpixel driving circuit of FIG. 5, the reference voltage VREF is applied to the reference node Nref for a period when the nth scan signal Scan(n) corresponds to a gate-on voltage.

The reference voltage VREF should be applied to the reference node Nref for the period when the n−1th scan signal Scan(n−1) and the nth scan signal Scan(n) correspond to the gate-on voltage, whereby each subpixel driving circuit may compensate for time-varying characteristics considering a voltage drop of the high potential voltage. Therefore, in FIGS. 4 and 5, at least one subpixel driving circuit is included in the unit pixel. In this case, the 7-1th transistor T7-1 for applying the reference voltage VREF to the reference node Nref in accordance with a compensation timing may be defined as a first compensation transistor, and the 7-2th transistor T7-2 may be defined as a second compensation transistor. The first compensation transistor and the second compensation transistor may commonly be referred to as a compensation transistor.

Hereinafter, a shape of the unit pixel and arrangement of the subpixel driving circuit will be described.

Figure 6:
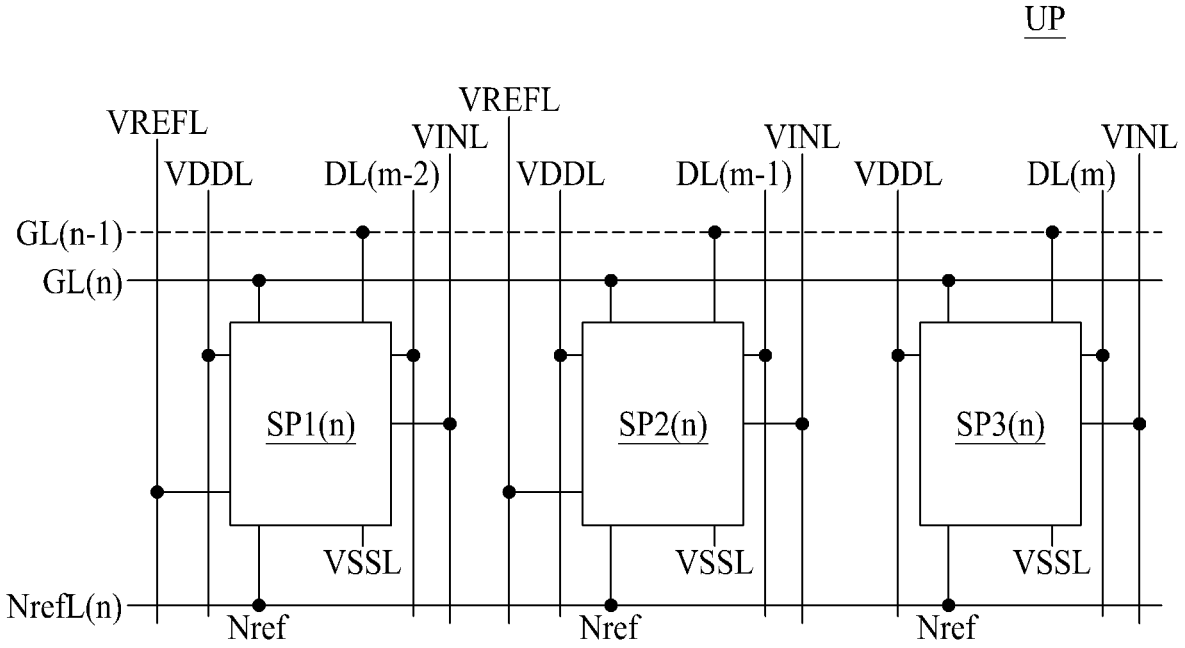
FIG. 6 is a unit pixel diagram according to an aspect of the present disclosure.

FIG. 6 is a unit pixel diagram according to an example aspect of the present disclosure.

The unit pixel UP according to an example aspect of the present disclosure includes three subpixels SP1(*n*), SP2(*n*), and SP3(*n*) connected to the nth pixel line. An n−1th gate line GL(n−1), an nth gate line GL(n), a reference voltage line VREFL, a high potential voltage line VDDL for applying the high potential voltage VDD, a low potential voltage line VSSL for applying a low potential voltage VSS, and an initialization voltage line VINL for applying an initialization voltage VINI are connected to each of the three subpixels SP1(*n*), SP2(*n*), and SP3(*n*). The first nth subpixel SP1(*n*) is connected to an m−2th data line DL(m−2), the second nth subpixel SP2(*n*) is connected to an m−1th data line DL(m−1), and the third nth subpixel SP3(*n*) is connected to the mth data line DL(m). In this case, the n−1th gate line GL(n−1) may be the n−1th scan line, and the nth gate line GL(n) may include an nth scan line and an nth emission line. The high potential voltage line VDDL, the reference voltage line VREFL, the low potential voltage line VSSL, and the initialization voltage line VINL may commonly be referred to as a power line.

As described above, in the unit pixel UP, because the reference voltage VREF should be applied to the reference node Nref for the period when the n−1th scan signal Scan (n−1) and the nth scan signal Scan(n) correspond to the gate-on voltage, the first nth subpixel SP1(*n*) and the second nth subpixel SP2(*n*) included in the unit pixel UP according to an example aspect of the present disclosure are connected to the reference voltage line VREFL for providing the reference voltage VREF. The reference voltage VREF is applied to the reference node Nref through the subpixel driving circuit of the first nth subpixel SP1(*n*) for the period when the n−1th scan signal Scan(n−1) corresponds to a gate-on voltage, and the reference voltage VREF is applied to the reference node Nref through the subpixel driving circuit of the second nth subpixel SP2(*n*) for the period when the nth scan signal Scan(n) corresponds to a gate-on voltage.

The reference node Nref included in each of the three subpixels SP1(*n*), SP2(*n*), and SP3(*n*) in the nth pixel line is connected to the nth reference node line NrefL(n). Therefore, the reference voltage VREF is applied to the reference node Nref of the subpixel driving circuit included in the three subpixels SP1(*n*), SP2(*n*), and SP3(*n*) connected to the nth pixel line for the period when the n−1th scan signal Scan(n−1) and the nth scan signal Scan(n) correspond to a gate-on voltage. The nth reference node line NrefL(n) may have a structure in which the reference nodes Nref of the nth subpixels in the nth pixel line are all connected, or may have a structure in which the reference nodes Nref of the nth subpixels included in the unit pixel UP are connected per unit pixel UP. In the latter case, the reference node line NrefL(n) is separated from a reference node line of an adjacent unit pixel UP, and only the reference nodes Nref included in the unit pixel UP share a voltage.

Because the reference voltage VREF is applied to the reference node Nref of the third nth subpixel SP3(*n*) through the first nth subpixel SP1(*n*) and the second nth subpixel SP2(*n*), the subpixel driving circuit has the reference node Nref but does not include a separate circuit for providing the reference voltage VREF to the reference node Nref.

Therefore, the subpixel driving circuit of the first nth subpixel SP1(*n*) according to an example aspect of the present disclosure may be the subpixel driving circuit of FIG. 4 in which the 7-1th transistor T7-1 is included, the subpixel driving circuit of the second nth subpixel SP2(*n*) may be the subpixel driving circuit of FIG. 5 in which the 7-2th transistor T7-2 is included, and the subpixel driving circuit of the third nth subpixel SP3(*n*) may be the subpixel driving circuit of FIG. 2.

The connection relation of the subpixels included in the unit pixel UP according to an example aspect of the present disclosure and the reference voltage line VREFL is not limited to the aspect of FIG. 6. However, any one of the subpixels SP1(*n*), SP2(*n*), and SP3(*n*) included in the unit pixel UP includes a subpixel driving circuit where the reference voltage may be applied to the reference node Nref in accordance with a timing of the n−1th scan signal Scan(n−1), and another one of the subpixels SP1(*n*), SP2(*n*), and SP3(*n*) includes a subpixel driving circuit where the reference voltage may be applied to the reference node Nref in accordance with a timing of the nth scan signal Scan(n).

Therefore, as the reference voltage VREF is applied to the reference node Nref included in the subpixel driving circuit, the subpixel driving circuits included in the unit pixel UP may solve a picture quality issue such as non-uniform vertical luminance or crosstalk on the display panel by providing the driving current which does not include a high potential voltage, to the light emitting diode EL, wherein the high potential voltage may cause a voltage drop of a voltage applying line.

Figure 7:
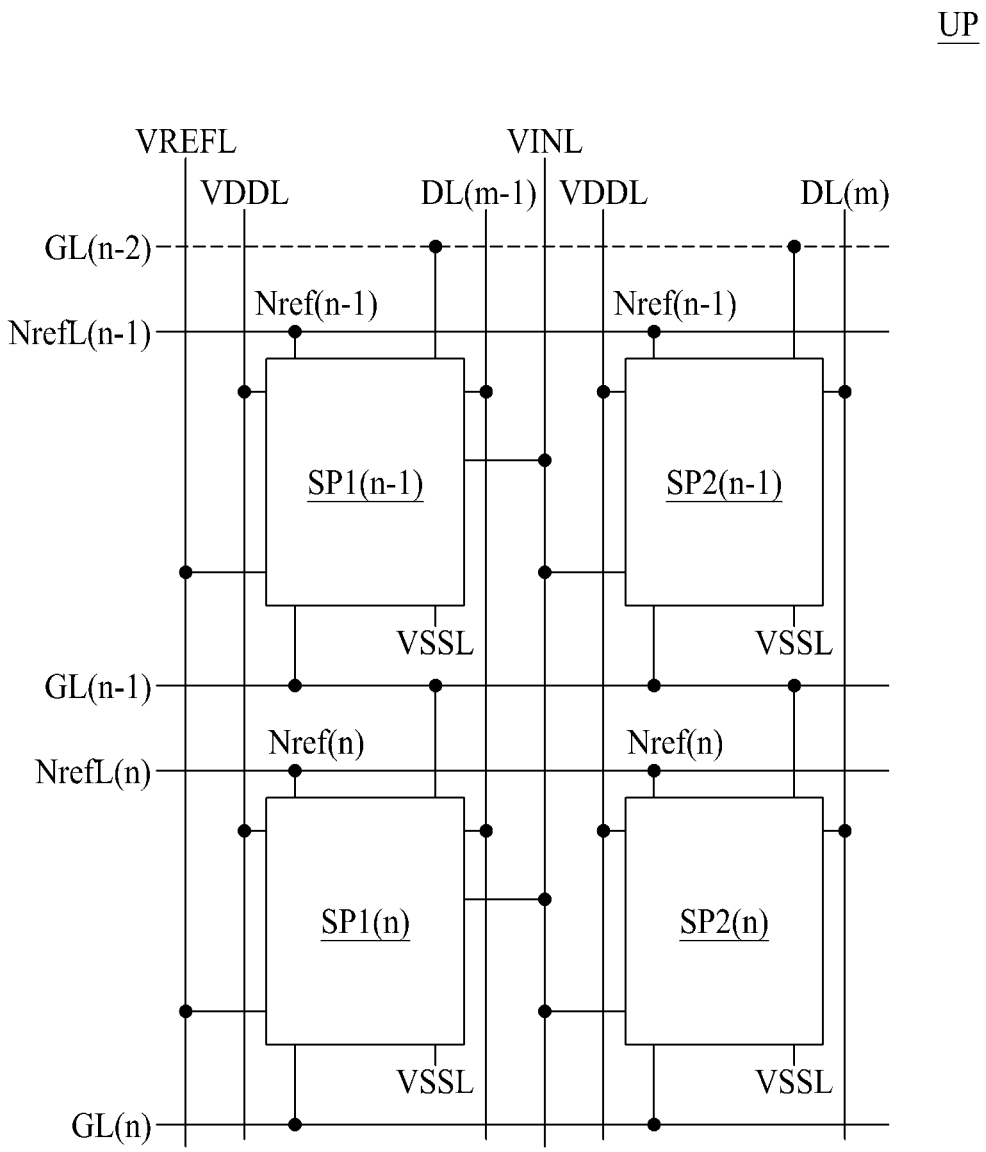
FIG. 7 is a unit pixel diagram according to an aspect of the present disclosure.

FIG. 7 is a unit pixel diagram according to an example aspect of the present disclosure.

The unit pixel UP according to an example aspect of the present disclosure includes two subpixels SP1(*n*−1) and SP2(*n*−1) connected to the n−1th pixel line and two subpixels SP1(*n*) and SP2(*n*) connected to the nth pixel line. An n−2th gate line GL(n−2), an n−1th gate line GL(n−1), a high potential voltage line VDDL for applying a high potential voltage VDD, and a low potential voltage line VSSL for applying a low potential voltage VSS are connected to each of the two subpixels SP1(*n*−1) and SP2(*n*−1) connected to the n−1th pixel line. The first n−1th subpixel SP1(*n*−1) and the first nth subpixel SP1(*n*) are connected to an m−1th data line DL(m−1), and the second n−1th subpixel SP2(*n*−1) and the second nth subpixel SP2(*n*) are connected to the mth data line DL(m). In this case, the n−2th gate line GL(n−2) may be the n−2th scan line, and each of the n−1th gate line GL(n−1) and the nth gate line GL(n) may include an n−1th scan line, an n−1th emission line, an nth scan line and an nth emission line. The initialization voltage line VINL is between the subpixels connected to the m−1th data line DL(m−1) and the subpixels connected to the mth data line DL(m), whereby the subpixels connected to the m−1th data line DL(m−1) and the subpixels connected to the mth data line DL(m) are supplied with the initialization voltage VINI from the same initialization voltage line VINL. The high potential voltage line VDDL, the reference voltage line VREFL, the low potential voltage line VSSL, and the initialization voltage line VINL may commonly be referred to as a power line.

As described above, in the unit pixel UP, because the reference voltage VREF should be applied to reference nodes Nref(n−1) and Nref(n) for the period when the n−1th scan signal Scan(n−1) and the nth scan signal Scan(n) correspond to the gate-on voltage, the reference voltage line VREFL for providing the reference voltage VREF is connected to the first n−1th subpixel SP1(*n*−1) and the first nth subpixel SP1(*n*) in the unit pixel UP according to an example aspect of the present disclosure. Because the first n−1th subpixel SP1(*n*−1) and the first nth subpixel SP1(*n*) are along a row, the first n−1th subpixel SP1(*n*−1) and the first nth subpixel SP1(*n*) are connected to the same reference voltage line VREFL. The reference voltage VREF is applied to the reference node Nref(n−1) through the subpixel driving circuit of the first n−1th subpixel SP1(*n*−1) for the period when the n−1th scan signal Scan(n−1) corresponds to a gate-on voltage, and the reference voltage VREF is applied to the reference node Nref(n) through the subpixel driving circuit of the first nth subpixel SP1(*n*) for the period when the nth scan signal Scan(n) corresponds to a gate-on voltage.

To share the reference voltage VREF applied to the reference node Nref(n−1) of the first n−1th subpixel SP1(*n*−1), the reference node Nref(n−1) of the first n−1th subpixel SP1(*n*−1) and the reference node Nref(n−1) of the second n−1th subpixel SP2(*n*−1) are connected to the n−1th reference node line NrefL(n−1). To share the reference voltage VREF applied to the reference node Nref(n) of the first nth subpixel SP1(*n*), the reference node Nref(n) of the second nth subpixel SP2(*n*) is connected to the nth reference node line NrefL(n).

In this case, in the first n−1th subpixel SP1(*n*−1) and the second n−1th subpixel SP2(*n*−1), the reference voltage VREF is applied to the reference node Nref(n−1) for the period corresponding to the gate-on voltage of the n−1th scan signal. In the first nth subpixel SP1(*n*) and the second nth subpixel SP2(*n*), the reference voltage VREF is applied to the reference node Nref(n) for the period corresponding to the gate-on voltage of the nth scan signal. Since the reference voltage VREF should be provided to each of the subpixels SP1($n$−1), SP2($n$−1), SP1($n$) and SP2($n$) included in the unit pixel UP for the period when the n−1th scan signal Scan(n−1) and the nth scan signal Scan(n) correspond to the gate-on voltages, the subpixels are implemented to be supplied with the time period when the reference voltage VREF is applied from the unit pixel arranged in parallel with the unit pixel UP shown in FIG. 7.

The unit pixel arranged in parallel with the unit pixel UP to adjoin the unit pixel UP according to the second aspect of the present disclosure may be implemented as a subpixel driving circuit in which the first n−1th subpixel SP1($n$−1) of the subpixels included in the unit pixel UP according to an example aspect of the present disclosure may receive the reference voltage VREF for the period when the nth scan signal Scan(n) corresponds to a gate-on voltage and the first nth subpixel SP1($n$) may receive the reference voltage VREF for the period when the n−1th scan signal Scan(n−1) corresponds to a gate-on voltage.

Therefore, in order that the reference voltage VREF is applied to the reference node Nref(n) of the subpixel driving circuit included in four subpixels arranged in the n−1th pixel line and included in two unit pixels and the reference node Nref(n) of the subpixel driving circuit included in four subpixels arranged in the nth pixel line and included in two unit pixels for the period when the n−1th scan signal Scan(n−1) and the nth scan signal Scan(n) correspond to the gate-on voltage, the n−1th reference node line NrefL(n−1) and the nth reference node line NrefL(n) are connected to the n−1th reference node and the nth reference node of the unit pixel UP and the unit pixel adjacent to the unit pixel UP.

In more detail, the n−1th reference node line NrefL(n−1) may have a structure in which the n−1th reference nodes Nref(n−1) of the n−1th subpixels in the n−1th pixel line are all connected, or may have a structure in which the n−1th reference nodes Nref(n−1) of the n−1th subpixels included in the n−1th unit pixel UP included in two unit pixels arranged in parallel at both sides in the n−1th pixel line are connected. In the same manner, the nth reference node line NrefL(n) may have a structure in which the reference nodes Nref(n) of the nth subpixels arranged in the nth pixel line are all connected, or may have a structure in which the reference nodes Nref(n) of the nth subpixels included in two unit pixels UP arranged in parallel at both sides in the nth pixel line are connected. In the latter case of each of the connection methods of the reference node lines, the n−1th reference node line NrefL(n−1) and the nth reference node line NrefL(n) are arranged in a unit of two pixels adjacent to each other and connected with the subpixels included in the two adjacent unit pixels, whereby only the reference nodes included in the two unit pixels share a voltage.

Since the reference voltage VREF is applied to the reference nodes Nref(n−1) and Nref(n) of the second n−1th subpixel SP2($n$−1) and the second nth subpixel SP2($n$) through the first n−1th subpixel SP1($n$−1) and the first nth subpixel SP1($n$), the subpixel driving circuit has the reference nodes Nref(n−1) and Nref(n) but does not include a separate circuit for providing the reference voltage VREF to the reference nodes Nref(n−1) and Nref(n).

Therefore, the subpixel driving circuit of the first n−1th subpixel SP1($n$−1) of the unit pixel UP according to an example aspect of the present disclosure may be the subpixel driving circuit of FIG. 4 in which the 7-1th transistor T7-1 is included, the subpixel driving circuit of the first nth subpixel SP1($n$) may be the subpixel driving circuit of FIG. 5 in which the 7-2th transistor T7-2 is included, and the subpixel driving circuit of the second n−1th subpixel SP2($n$−1) and the second nth subpixel SP2($n$) may be the subpixel driving circuit of FIG. 2.

The connection relation of the subpixels included in the unit pixel UP according to an example aspect of the present disclosure and the reference voltage line VREFL is not limited to the aspect of FIG. 7. However, any one of the subpixels SP1($n$−1), SP2($n$−1), SP1($n$) and SP2($n$) included in the unit pixel UP includes a subpixel driving circuit where the reference voltage VREF may be applied to the reference node in accordance with a timing of the n−1th scan signal Scan(n−1), and another one of the subpixels SP1($n$−1), SP2($n$−1), SP1($n$) and SP2($n$) includes a subpixel driving circuit where the reference voltage VREF may be applied to the reference node in accordance with a timing of the nth scan signal Scan(n). However, to avoid unnecessary arrangement of the reference voltage line VREFL, the subpixels which include the subpixel driving circuit for applying the reference voltage VREF to the reference node in accordance with a timing of the n−1th scan signal Scan(n−1) and the nth scan signal Scan(n) may be arranged in the same column.

Therefore, as the reference voltage VREF is applied to the reference node Nref included in the subpixel driving circuit, the subpixel driving circuits included in the unit pixel UP may solve a picture quality issue such as non-uniform vertical luminance or crosstalk on the display panel by providing the driving current, which does not include a high potential voltage, to the light emitting diode EL, wherein the high potential voltage may cause a voltage drop of a voltage applying line.

The subpixel driving circuit and the electroluminescent display device according to the aspect of the present disclosure may be described as follows.

According to an aspect of the present disclosure, an electroluminescent display device comprises a pixel including a plurality of subpixels, a plurality of power lines for providing a power voltage to the plurality of subpixels, a data line for providing data signals to the plurality of subpixels, a plurality of gate lines for providing gate signals to the plurality of subpixels, and a reference node line for connecting a plurality of reference nodes included in the plurality of subpixels. Each of the subpixels comprises a light emitting diode, and a subpixel driving circuit for controlling light emission of the light emitting diode, and the subpixel driving circuit provides a driving current without including a high potential voltage to the light emitting diode as a reference voltage that is applied from one of the plurality of power lines to the reference node included in the subpixel, and some of the plurality of subpixels include a compensation transistor connected to the reference node receiving the reference voltage. Therefore, since the reference voltage is applied to the reference node of the subpixels connected through the reference node line, the reference voltage provided to the reference node through the compensation transistor included in some of the subpixels may solve a problem of picture quality of the electroluminescent display device by providing the driving current, which is not affected by the high potential voltage, to the light emitting diode.

For example, in the electroluminescent display device according to an aspect of the present disclosure, the plurality of subpixels may be on a position where the plurality of gate lines in a row direction cross the data line in a column direction, and the reference node line may connect the plurality of reference nodes included in the plurality of subpixels arranged in the row direction.

For example, in the electroluminescent display device according to an aspect of the present disclosure, the power lines may include a high potential voltage line for providing the high potential voltage, a reference voltage line for providing the reference voltage, and an initialization voltage line for providing an initialization voltage to the plurality of subpixels, and the compensation transistor may be connected to the reference node and the reference voltage line.

For example, in the electroluminescent display device according to an aspect of the present disclosure, the plurality of gate lines may include a scan line for providing a scan signal and an emission line for providing an emission signal.

For example, in the electroluminescent display device according to an aspect of the present disclosure, the plurality of subpixels may be arranged in an nth row, and may receive an (n−1)th scan signal and an nth scan signal through an (n−1)th scan line and an nth scan line, respectively.

For example, in the electroluminescent display device according to an aspect of the present disclosure, the subpixels may include a subpixel which includes a first compensation transistor controlled by the (n−1)th scan signal and connected to a reference voltage line for providing the reference voltage, and a subpixel which includes a second compensation transistor controlled by the nth scan signal and connected to the reference voltage line.

For example, in the electroluminescent display device according to an aspect of the present disclosure, the pixel may be a minimum unit which can express all colors, the plurality of subpixels included in the pixel may be arranged in a direction where the plurality of gate lines are arranged, and the subpixel driving circuit of at least two of the subpixels may include the compensation transistor.

For example, in the electroluminescent display device according to an aspect of the present disclosure, the pixel may be a minimum unit which can express all colors, the plurality of subpixels included in the pixel may be in a direction where at least two gate lines and at least two data lines are arranged, and the subpixel driving circuits of the plurality of sub pixels in at least one data line, among the subpixels, may include the compensation transistor.

For example, in the electroluminescent display device according to an aspect of the present disclosure, the subpixel driving circuit includes a driving transistor that uniformly may provide the driving current to the light emitting diode, and the subpixel driving circuit may comprise a first initialization period for initializing a gate node of the driving transistor, a sampling and second initialization period for sampling a threshold voltage of the driving transistor and initializing the light emitting diode, a holding period for maintaining a data voltage applied through the data line, and a light emission period for allowing the light emitting diode to emit light through the driving current generated based on the data voltage. The reference voltage may be applied to the reference node for the first initialization period and the sampling and second initialization period.

For example, in the electroluminescent display device according to an aspect of the present disclosure, the subpixel driving circuit may include a capacitor for charging the data voltage, and one end of the capacitor may be connected to the reference node and the other end of the capacitor may be connected to the gate node of the driving transistor.

According to an aspect of the present disclosure, an electroluminescent display device comprises a unit pixel existing in a minimum area where all colors can be expressed through combination of three primary colors, wherein the unit pixel includes at least one subpixel including a first compensation transistor and at least one subpixel including a second compensation transistor, the at least one subpixel includes a reference node for providing a reference voltage transferred through a light emitting diode, a driving transistor, switching transistors, a capacitor, and the first compensation transistor or the second compensation transistor, and a reference node line for connecting the reference node is arranged in the unit pixel. Therefore, since the reference voltage is applied to the reference node of the subpixels included in the unit pixel through the compensation transistor and the reference voltage is applied to the reference node of the other subpixels within the unit pixel through the reference node line, the driving current which is not affected by the high potential voltage may be provided to the light emitting diode, whereby a problem of picture quality of the electroluminescent display device may be solved.

For example, in the electroluminescent display device according to an aspect of the present disclosure, the light emitting diode may include an anode to which a driving current allowing the light emitting diode to emit light is applied and a cathode to which a low potential voltage is applied. The driving transistor may have a gate connected with one end of the capacitor, a high potential voltage and a data voltage may be applied to a source of the driving transistor through the switching transistors, and the other end of the capacitor may be connected with the reference node.

For example, in the electroluminescent display device according to an aspect of the present disclosure, the reference voltage may be a voltage value between a high potential voltage and a low potential voltage.

For example, in the electroluminescent display device according to an aspect of the present disclosure, the unit pixel may include at least three subpixels for emitting light of red, blue and green.

For example, in the electroluminescent display device according to an aspect of the present disclosure, the first compensation transistor and the second compensation transistor may be connected to gate lines different from each other and thus turned on at timings different from each other.

For example, in the electroluminescent display device according to an aspect of the present disclosure, the reference node of the subpixel, which does not include the first compensation transistor and the second compensation transistor, among the subpixels included in the unit pixel, may be connected to the reference node line, whereby the reference voltage may be applied to the reference node.

For example, in the electroluminescent display device according to an aspect of the present disclosure, the unit pixel may include subpixels arranged in an nth pixel line, gates of the first compensation transistor and the second compensation transistor may be connected to an n−1th scan line and an nth scan line, respectively, and first electrodes of the first compensation transistor and the second compensation transistor may be connected with different reference voltage lines for respectively applying a reference voltage.

For example, in the electroluminescent display device according to an aspect of the present disclosure, the reference node lines may be arranged per unit pixel, and thus may be separated from the reference node lines of adjacent unit pixels.

For example, in the electroluminescent display device according to an aspect of the present disclosure, the unit pixel may include subpixels arranged in an n−1th pixel line and an nth pixel line, and gates of the first compensation transistor and the second compensation transistor may be connected to the n−1th scan line and the nth scan line, respectively, and the first electrodes of the first compensation transistor and the second compensation transistor may be connected with one reference voltage line for applying a reference voltage.

For example, in the electroluminescent display device according to an aspect of the present disclosure, the reference node lines may connect unit pixels, which are arranged to adjoin each other, with each other.

For example, in the electroluminescent display device according to an embodiment of the present disclosure, the at least one subpixel may comprise a light emitting diode and a subpixel driving circuit for controlling light emission of the light emitting diode.

For example, in the electroluminescent display device according to an embodiment of the present disclosure, the subpixel driving circuit may provide a driving current without including a high potential voltage to the light emitting diode as the reference voltage.

For example, in the electroluminescent display device according to an embodiment of the present disclosure, the at least one subpixel may be arranged in an nth row and respectively receives an (n−1)th scan signal and an nth scan signal through an (n−1)th scan line and an nth scan line.

For example, in the electroluminescent display device according to an embodiment of the present disclosure, the first compensation transistor may be controlled by the (n−1) th scan signal and provides the reference voltage and the second compensation transistor may be controlled by the nth scan signal.

It will be apparent to those skilled in the art that the present disclosure described above is not limited by the above-described aspects and the accompanying drawings and that various substitutions, modifications, and variations can be made in the present disclosure without departing from the spirit or scope of the disclosures. Consequently, the scope of the present disclosure is defined by the accompanying claims, and it is intended that all variations or modifications derived from the meaning, scope, and equivalent concept of the claims fall within the scope of the present disclosure.

These and other changes can be made to the aspects in light of the above-detailed description. In general, in the following claims, the terms used should not be construed to limit the claims to the specific aspects disclosed in the specification and the claims, but should be construed to include all possible aspects along with the full scope of equivalents to which such claims are entitled. Accordingly, the claims are not limited by the disclosure.

What is claimed is:

1. An electroluminescent display device comprising:

a pixel including a plurality of subpixels, each subpixel having a capacitor;

a data line for providing data signals to the plurality of subpixels;

a plurality of gate lines for providing gate signals to the plurality of subpixels;

a reference node line connecting a plurality of reference nodes in the plurality of subpixels with one another and directly connected to the capacitor included in each subpixel;

a reference voltage line for providing a reference voltage to the capacitor of each subpixel through the plurality of reference nodes; and a compensation transistor directly connected to the reference voltage line and the reference node to transfer the reference voltage to each of the plurality of reference nodes;

wherein each of the subpixels comprises a light emitting diode and a subpixel driving circuit for controlling light emission of the light emitting diode, wherein the subpixel driving circuit in a subpixel includes a driving transistor that provides a driving current to the light emitting diode and the capacitor that charges a data voltage and has one end connected to the reference node and another end connected to a gate node of the driving transistor, wherein the driving current is not affected by high potential voltage provided through one of a plurality of power lines and transferred to the driving transistor, wherein the driving current is generated by using the reference voltage that is applied from one of the plurality of power lines to the reference node included in the subpixel, and wherein the compensation transistor includes a first compensation transistor having a gate connected to an (n−1)th scan signal line, a source connected to the reference voltage line and a drain connected to the reference node or a second compensation transistor having a gate connected to an nth scan signal line, a source connected to the reference voltage line and a drain connected to the reference node, wherein at least one of the plurality of subpixels includes the first compensation transistor as the compensation transistor, and wherein at least one of the plurality of subpixels includes the second compensation transistor as the compensation transistor.

2. The electroluminescent display device according to claim 1, wherein the plurality of subpixels is disposed at a position where the plurality of gate lines in a row direction cross the data line in a column direction, and the reference node line connects the plurality of reference nodes included in the plurality of subpixels arranged in the row direction.

3. The electroluminescent display device according to claim 1, further comprising:

a high potential voltage line for providing the high potential voltage; and an initialization voltage line for providing an initialization voltage to the plurality of subpixels.

4. The electroluminescent display device according to claim 1, wherein the plurality of gate lines includes the (n−1)th scan signal line for providing an (n−1)th scan signal, the nth scan signal line for providing an nth scan signal and an emission line for providing an emission signal.

5. The electroluminescent display device according to claim 4, wherein the plurality of subpixels is arranged in an nth row and respectively receives the (n−1)th scan signal and the nth scan signal through the (n−1)th scan signal line and the nth scan signal line.

6. The electroluminescent display device according to claim 1, wherein the pixel is a minimum unit which can express all colors, the plurality of subpixels included in the pixel is arranged in a direction where the plurality of gate lines is arranged, and wherein the subpixel driving circuit of at least two of the subpixels includes the compensation transistor.

7. The electroluminescent display device according to claim 1, wherein the pixel is a minimum unit which can express all colors, the plurality of subpixels included in the pixel is in a direction where at least two gate lines and at least two data lines are arranged, and wherein the subpixel driving circuit of the plurality of sub pixels in at least one data line, among the subpixels, includes the compensation transistor.

8. The electroluminescent display device according to claim 1, wherein the subpixel driving circuit comprises:

a first initialization period for initializing the gate node of the driving transistor;

a sampling and second initialization period for sampling a threshold voltage of the driving transistor and initializing the light emitting diode;

a holding period for maintaining the data voltage applied through the data line; and a light emission period for allowing the light emitting diode to emit light through the driving current generated based on the data voltage, and wherein the reference voltage is applied to the reference node for the first initialization period and the sampling and second initialization period.

9. An electroluminescent display device comprising:

a unit pixel existing in a minimum area where all colors can be expressed through combination of three primary colors, wherein at least one subpixel includes a light emitting diode, a driving transistor, switching transistors, a capacitor, and a reference node;

a reference node line connecting a plurality of reference nodes in the plurality of subpixels with one another and directly connected to the capacitor included in each subpixel;

a reference voltage line for providing a reference voltage to the capacitor of each subpixel through the plurality of reference nodes; and a compensation transistor directly connected to the reference voltage line and the reference node to transfer the reference voltage to the reference node, wherein the unit pixel includes at least one subpixel including a first compensation transistor controlled by an (n−1)th scan signal and at least one subpixel including a second compensation transistor controlled by an nth scan signal, wherein the capacitor charges a data voltage and has one end connected to the reference node and another end connected to a gate node of the driving transistor, wherein the first compensation transistor has a gate connected to an (n−1)th scan signal line, a source connected to the reference voltage and a drain connected to the reference node and the second compensation transistor having a gate connected to an nth scan signal line, a source connected to the reference voltage and a drain connected to the reference node, wherein the reference node line for connecting the plurality of reference nodes is arranged in the unit pixel, wherein a driving current is provided to the light emitting diode, wherein the driving current is not affected by high potential voltage transferred to the driving transistor, wherein the driving current is generated by using the reference voltage that is applied to the reference node, and wherein the at least one subpixel including the first compensation transistor is different from the at least one subpixel including the second compensation transistor.

10. The electroluminescent display device according to claim 9, wherein the light emitting diode includes an anode to which a driving current allowing the light emitting diode to emit light is applied and a cathode to which a low potential source is applied.

11. The electroluminescent display device according to claim 10, wherein the high potential voltage and the data voltage are applied to a source of the driving transistor through the switching transistors.

12. The electroluminescent display device according to claim 10, wherein the reference voltage is a voltage value between the high potential voltage and the low potential voltage.

13. The electroluminescent display device according to claim 9, wherein the unit pixel includes at least three subpixels for emitting light of red, blue and green.

14. The electroluminescent display device according to claim 9, wherein the first compensation transistor and the second compensation transistor are connected to gate lines different from each other and thus turned on at timings different from each other.

15. The electroluminescent display device according to claim 9, wherein the at least one subpixel comprises the light emitting diode and a subpixel driving circuit for controlling light emission of the light emitting diode.

16. The electroluminescent display device according to claim 15, wherein the subpixel driving circuit provides the driving current to the light emitting diode.

17. The electroluminescent display device according to claim 9, wherein the at least one subpixel including the first compensation transistor and the at least one subpixel including the second compensation transistor are arranged in an nth row and receive the (n−1)th scan signal and the nth scan signal through the (n−1)th scan signal line and the nth scan signal line.

* * * * *